US005217396A

United States Patent [19]

Castanga et al.

[11] Patent Number: 5,217,396

[45] Date of Patent: Jun. 8, 1993

[54] CABLE TERMINATING CONNECTOR ASSEMBLY

[75] Inventors: Lou Castanga, Harrisburg; Dennis G. Dupler, York Haven; Scott A. Shuey, Harrisburg, all of Pa.

[73] Assignee: AMP Incorporated, Harrisburg, Pa.

[21] Appl. No.: 914,911

[22] Filed: Jul. 16, 1992

[51] Int. Cl.[5] ..... H01R 13/42

[52] U.S. Cl. ..... 439/751; 439/404; 439/873

[58] Field of Search ..... 439/733, 741, 751, 870–873, 439/743–746, 395–407

[56] References Cited

U.S. PATENT DOCUMENTS

| | | | |
|---|---|---|---|
| 4,156,553 | 5/1979 | Anmon et al. | 439/873 |
| 4,296,988 | 10/1981 | Warner | 439/398 |
| 4,330,164 | 5/1981 | Pittman et al. | 439/395 |
| 4,344,665 | 8/1982 | Racilla et al. | 439/407 |
| 4,781,615 | 11/1988 | Davis et al. | 439/395 |

*Primary Examiner*—David L. Pirlot
*Attorney, Agent, or Firm*—William B. Noll

[57] ABSTRACT

An electrical connector assembly includes a housing (20) having a mating face (22) and an opposed rear face (24), the housing being formed with a plurality of contact receiving passageways (26) extending between the mating face and the rear face. Each of the passageways contains a contact (40) which includes a generally linear central body portion (42), a terminal portion (46) at a first end of the central body portion which includes a slotted insulation displacing plate (48) adapted to mechanically and electrically engage an individual cable wire, a generally linear pin receiving beam portion (50) at the second end of the central body portion (42) which is offset from the line (52) defined by the linear central body portion, and retention means (44) on the central body portion for engaging the housing (20) to retain the contact in its passageway (26). Each of the housing passageways (26) is formed with a major passageway (28) of uniform width extending from the mating face (22) to the rear face (24) and a cavity (30) of width less than the uniform width adjacent to and communicating with the major passageway (28).

5 Claims, 6 Drawing Sheets

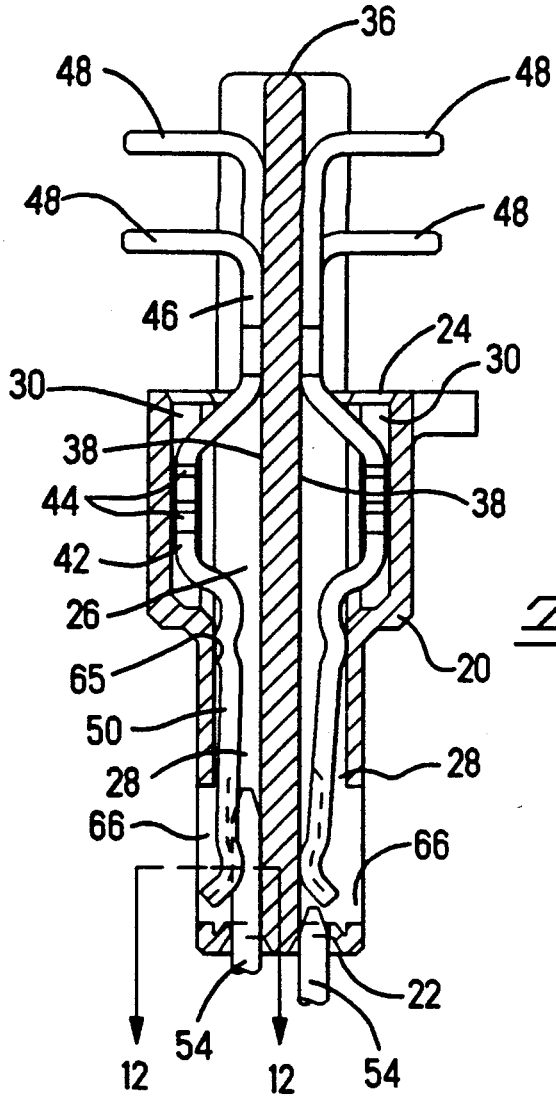
Fig. 11
Fig. 12A
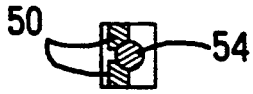
Fig. 12B
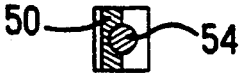

CABLE TERMINATING CONNECTOR ASSEMBLY

BACKGROUND OF THE INVENTION

This invention relates to connector assemblies and, more particularly, to a connector assembly for terminating a cable for connection to a pin header mounted to a printed circuit board.

It is often desirable to be able to connect a cable directly to a printed circuit board. Toward this end, the printed circuit board is typically provided with a pin header mounted thereto, with the pins of the pin header being electrically coupled to wiring traces on the printed circuit board It is therefore a primary object of the present invention to provide an electrical connector assembly for terminating a cable, the connector assembly being matable with a pin header mounted to a printed circuit board.

U.S. Pat. No. 4,781,615, the contents of which are hereby incorporated by reference, discloses a cable terminating connector assembly wherein contacts retained within the connector housing have outwardly extending pins surrounded by a shield for engagement with a complementary mating connector. The connector assembly disclosed in the aforereferenced patent includes a cable terminating cover retention system which operates in a satisfactory manner. It is therefore another object of this invention to be able to utilize the cable terminating cover retention system of the aforereferenced patent in an electrical connector assembly which is matable with a pin header mounted to a printed circuit board.

SUMMARY OF THE INVENTION

The foregoing, and additional, objects are attained in accordance with the principles of this invention by providing an electrical connector assembly for terminating a cable having a plurality of individual insulated wires and for mating with a pin header mounted to a printed circuit board so that electrical connections between the wires of the cable and traces on the printed circuit board are effected. The assembly comprises a housing having a mating face and an opposed rear face. The housing is formed with a plurality of contact receiving passageways extending between the mating face and the rear face. Each of the passageways contains a contact which includes a generally linear central body portion, a terminal portion at a first end of the central body portion which includes a slotted insulation displacing plate adapted to mechanically and electrically engage an individual cable wire, a generally linear pin receiving beam portion at the second end of the central body portion which is offset from the line defined by the linear central body portion, and retention means on the central body portion for engaging the housing to retain the contact in its passageway. According to this invention, each of the housing passageways is formed with a major passageway of uniform width extending from the mating face to the rear face and a cavity of width less than the uniform width adjacent to and communicating with the major passageway. The cavity extends into the housing from the rear face a distance sufficient to contain therein the central body portion of the contact, with the offset pin receiving beam portion being contained in the major passageway.

In accordance with an aspect of this invention, the contact beam portion is wider than the contact central body portion and the cavity, and narrower than the uniform width.

In accordance with a further aspect of this invention, the contact retention means includes at least one barb.

BRIEF DESCRIPTION OF THE DRAWINGS

The foregoing will be more readily apparent upon reading the following description in conjunction with the drawings in which like elements in different FIGS. are identified by the same reference numeral and wherein:

FIG. 11 is a cross sectional view of a connector housing according to this invention showing how a pin from a pin header engages a contact disposed in the connector housing;

FIG. 12A is a cross sectional view taken along the line 12—12 in FIG. 11 showing a first embodiment of a contact constructed according to this invention; and FIG. 12B is a cross sectional view taken along the line 12—12 in FIG. 11 showing a second embodiment of a contact constructed according to this invention.

DETAILED DESCRIPTION

Figure 1:
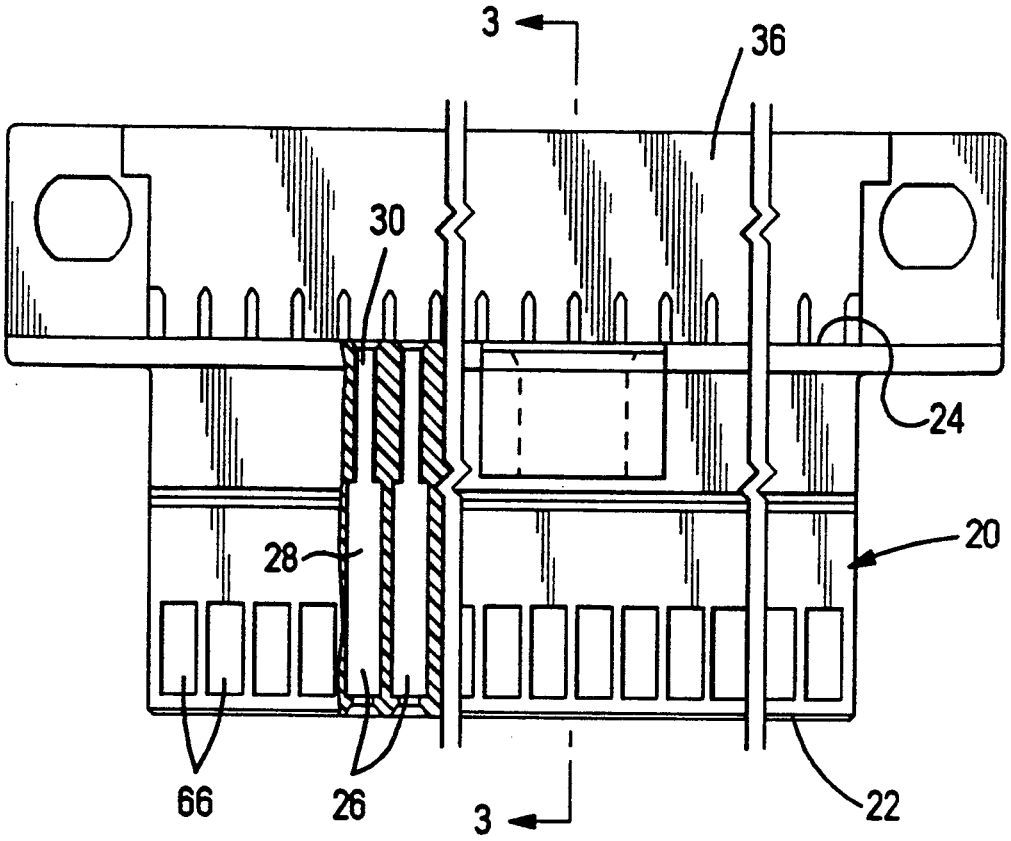
FIG. 1 is a partially sectioned elevational view of a connector housing constructed according to this invention.
Figure 2:
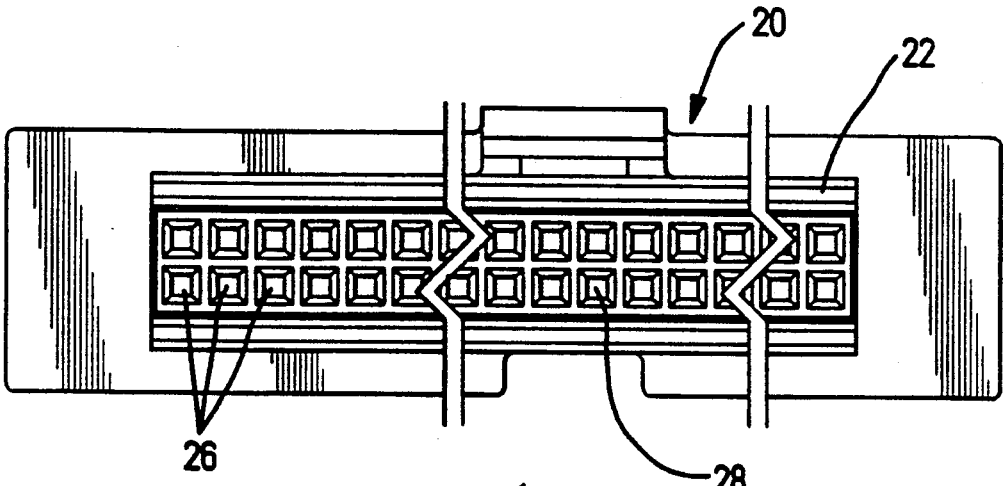
FIG. 2 is a bottom view of the housing of FIG. 1.
Figure 3:
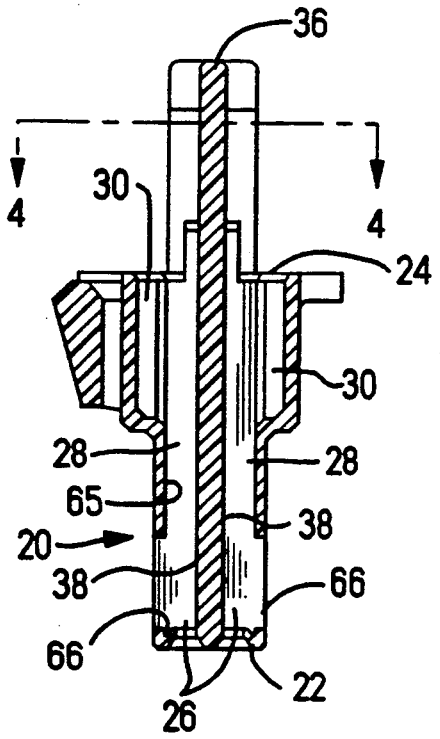
FIG. 3 is a cross sectional view taken along the line 3—3 in 1.
Figure 4:
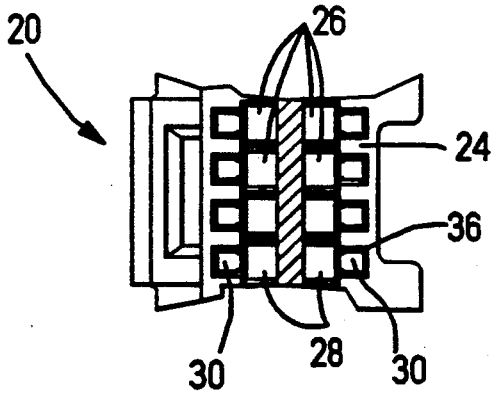
FIG. 4 is a cross sectional view taken along the line 4—4 in FIG. 3.

Referring now to the drawings, the electrical connector assembly according to this invention includes a housing 20 having a mating face 22 and an opposed rear face 24. The housing 20 is preferably molded from a plastic insulative dielectric material and is formed with a plurality of contact receiving passageways 26 which extend between the mating face 22 and the rear face 24. Specifically, each of the contact receiving passageways 26 is formed with a major passageway 28 which extends from the mating face 22 to the rear face 24 and is of uniform width along its entire length when viewed in the direction of FIG. 1. Each contact receiving passageway 26 also includes a cavity 30 having a width less than the uniform width of the major passageway 28. The cavity 30 extends into the housing 20 from the rear face 24 part of the way toward the mating face 22. Along its entire length, the cavity 30 communicates with the major passageway 28.

Preferably, the passageways 26 are disposed in a linear array of two rows, to match the array of pins in a pin header 32 mounted to a printed circuit board 34, the housing 20 being designed to mate with the pin header 32. The relatively thin wall of the housing 20 which is between the two rows of passageways 26 extends beyond the rear face as a terminal support wall 36. The terminal support wall 36 is a continuation of a first wall 38 of the major passageway 28 which is opposite the side of the major passageway 28 which communicates with the cavity 30.

Figure 8:
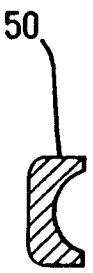
FIG. 8 is a cross sectional view taken along the line 8—8 in FIG. 6 for a first embodiment of a contact constructed according to this invention.
Figure 7:
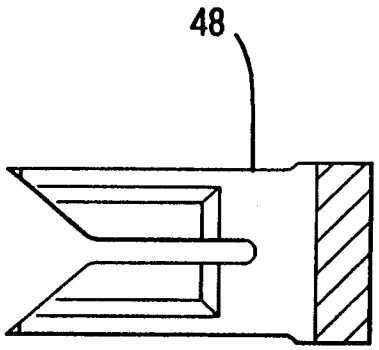
FIG. 7 is a cross sectional view taken along the line 7—7 in FIG. 6.
Figure 6:
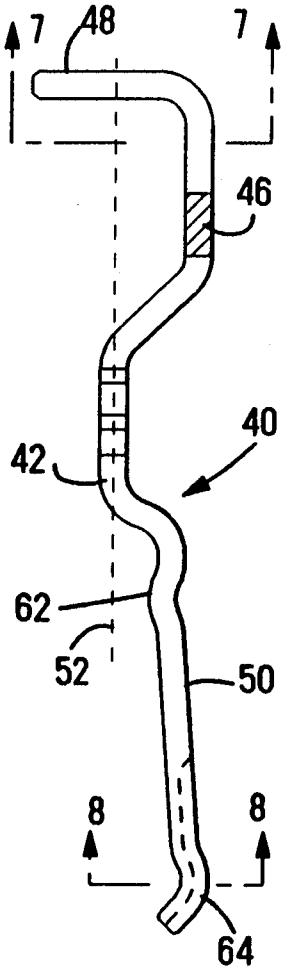
FIG. 6 is a side view of the contact shown in FIG. 5.
Figure 5:
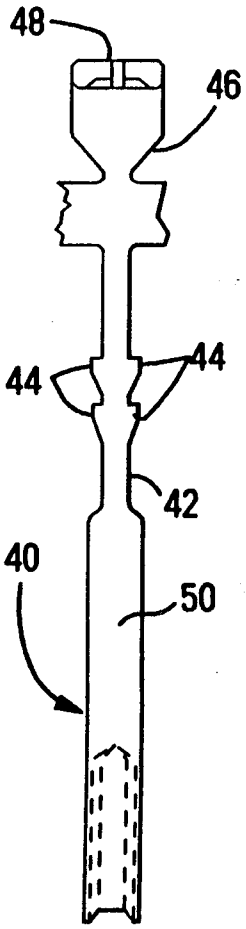
FIG. 5 is an elevational view of a contact constructed in accordance with the principles of this invention for use with the housing of FIGS. 1–4.
Figure 9:
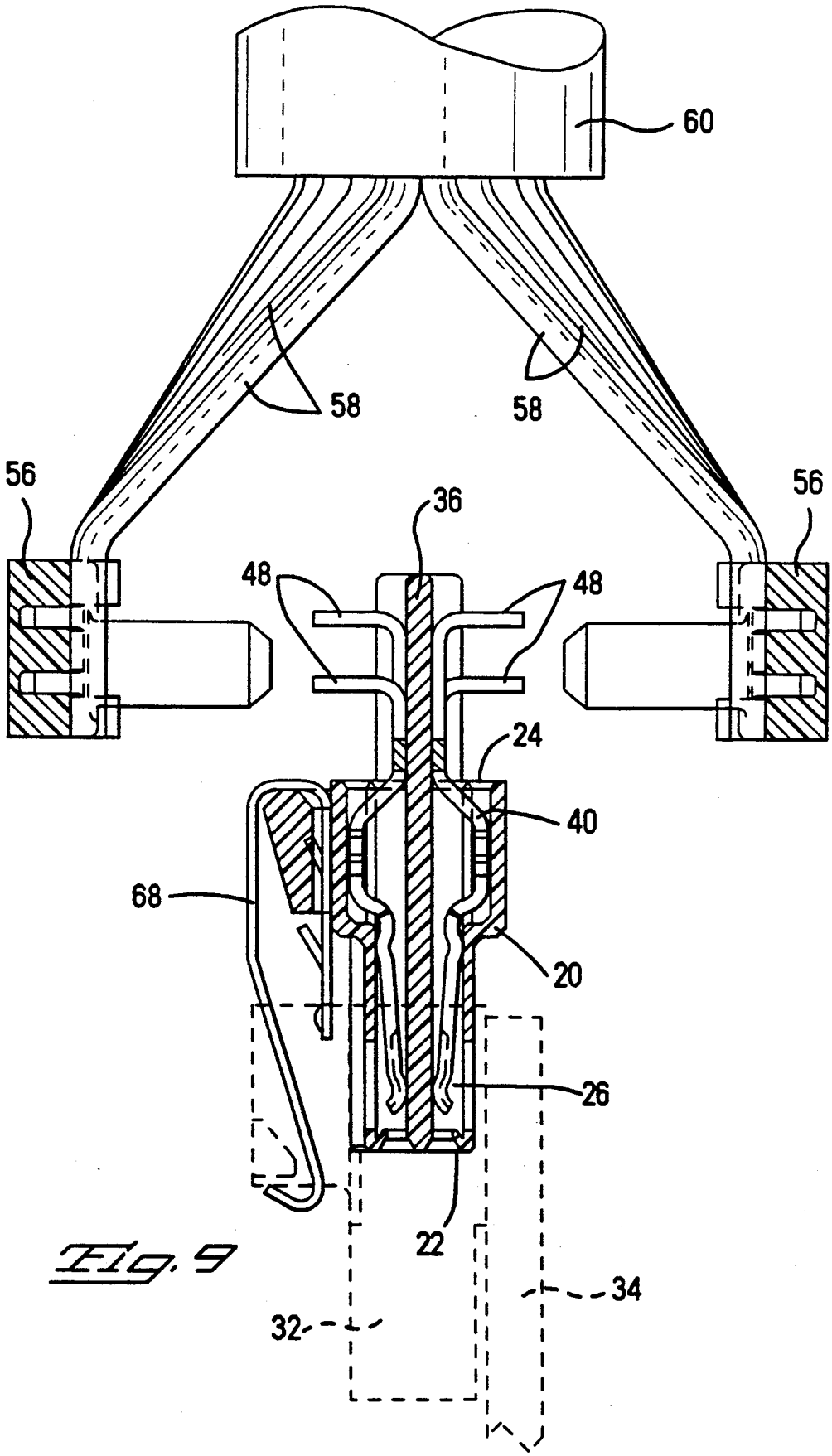
FIG. 9 illustrates, in cross section, a cable terminated to a connector assembly according to this invention which is mated with a pin header mounted to a printed circuit board.
Figure 10:
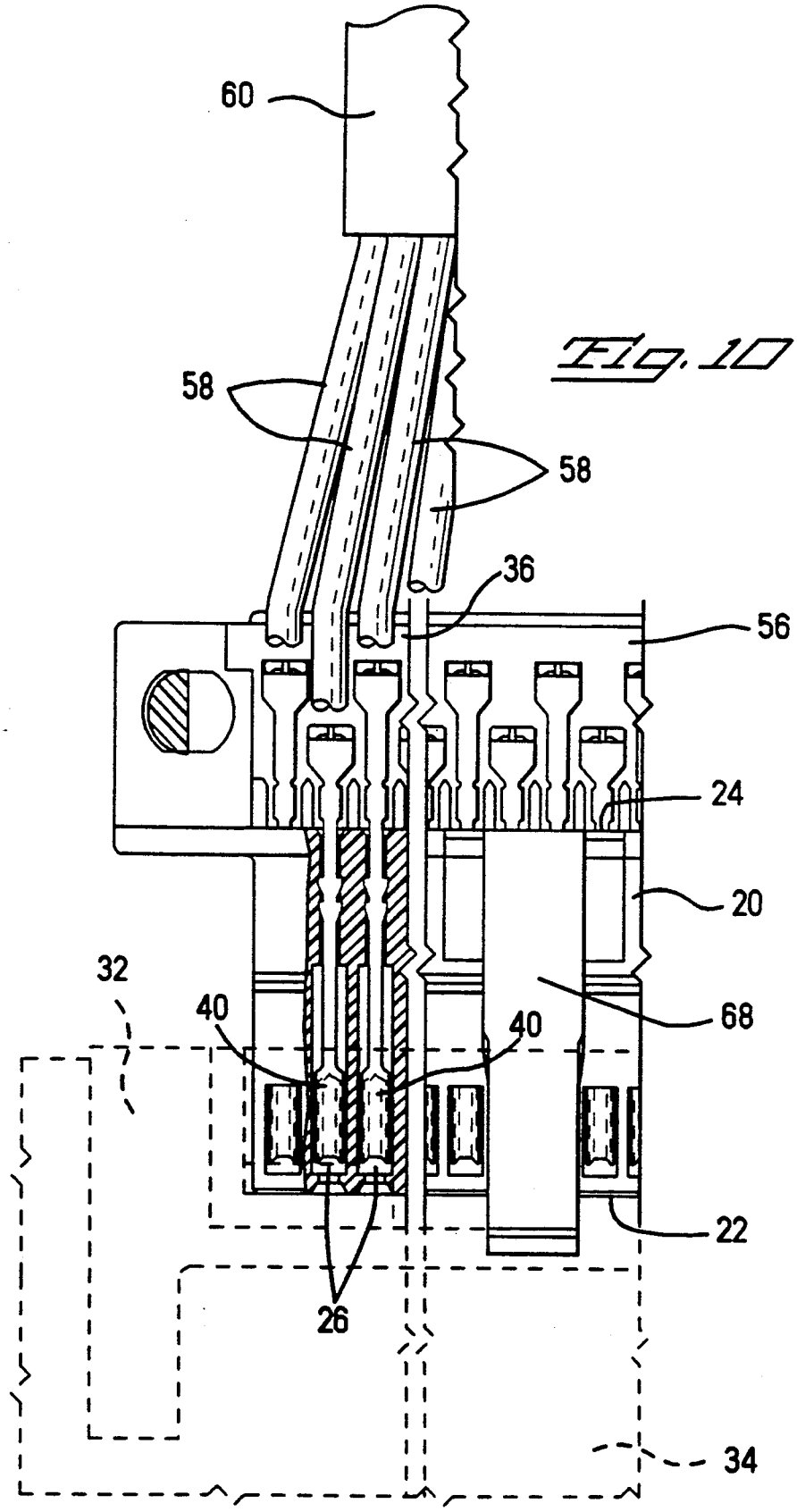
FIG. 10 is a side view, partially in cross section of the assembly shown in FIG. 9.

Each of the passageways 26 holds a contact constructed according to this invention. Such a contact, designated generally by the reference numeral 40, is shown in FIGS. 5–8. The contact 40 includes a generally linear central body portion 42 on which are formed barbs 44 which serve to retain the contact 40 in the passageway 26, as will be described hereinafter. The contact 40 further includes a terminal portion 46 extending from a first end of the central body portion 42. The terminal portion 46 preferably includes a slotted insulation displacing plate 48 which is adapted to mechanically and electrically engage an individual cable wire, as will be described hereinafter. Lastly, contact 40 includes a generally linear pin receiving beam portion 50 extending from the second end of the central body portion 42. The beam portion 50 is offset from the line 52 defined by the central body portion 42. As is shown in FIG. 5, the beam portion 50 is wider than the central body portion 42. Further, although not shown in FIGS. 5 and 6, the terminal portion 46 is made in two different lengths, as disclosed in the referenced '615 patent, so that two parallel rows of insulation displacing plates 48 are provided, as shown in FIGS. 9–11. Further, at its distal end, the beam portion 50 may be formed with a variety of configurations. Thus, as illustrated in FIGS. 8 and 12A, in a first embodiment the distal end of the beam portion 50 is channelled. As shown in FIG. 12B, in a second embodiment the distal end of the beam portion 50 is split, or bifurcated. Both of these configurations provide improved contact with a pin 54 of the pin header 32, when compared with a planar configuration for the distal end of the beam portion 50. For assembly, the contacts 40 are inserted into their respective passageways 26 in the housing 20 from the rear face 24 thereof. Such insertion is effected by initially inserting the distal end of the beam portion 50 into a passageway 26. The width of the beam portion 50 is greater than the width of the cavity 30 and less than the width of the major passageway 28 so that the beam portion 50 travels along the major passageway 28. As the central body portion 42 passes the rear face 24 of the housing 20, it enters the cavity 30 since it is offset from the beam portion 50. The width of the central body portion 42 is less than the width of the cavity 30, but the lateral extent of the barbs 44 is greater than the width of the cavity 30. Accordingly, as the contact 40 is forced into the passageway 26, the barbs 44 displace the plastic material of the housing 20. Due to the slant of the barbs 44, once inserted, the contact 40 is not easily removed from the passageway 26. As shown in the drawings, the terminal portion 46 of the contact 40 includes a linear section which engages the terminal support wall 36.

As disclosed in the referenced '615 patent, the connector assembly includes a pair of terminating covers 56 having flutes in which individual insulated wires 58 of a cable 60 are disposed. When the covers 56 are joined together from opposite sides of the terminal support wall 36, the slotted insulation displacing plates 48 of the contacts 40 mechanically and electrically engage the wires 58.

Preferably, the beam portion 50 of the contact 40 is slanted with respect to the central body portion 42. The beam portion 50, while generally linear, is formed with a rounded protrusion 62 at its proximal end which extends toward the line 52 of the beam portion 42, and another rounded protrusion 64 at its distal which extends in the opposite direction. When inserted into the passageway 26, the protrusion 62 engages a second wall 65 of the major passageway 28 opposite the first wall 38 and adjacent to where the second wall 65 communicates with the cavity 30, and the protrusion 64 engages the first wall 38 of the major passageway 28.

As shown in FIG. 11, as the housing 20 mates with the pin header 32 and a pin 54 enters the major passageway 28 from the mating face 22 of the housing 20, the pin 54 deflects the beam portion 50 of the contact 40 away from the wall 38. Openings 66 are provided in the walls of the housing 20 which communicate with the major passageways 28 through the second walls 65 in the vicinity of the mating face 22 so that the distal ends of the beam portions 50 of the contacts 40 have room for their displacement by the pins 54.

After the housing 20 is fully mated with the pin header 32, it may be retained therein by means of a latch 68.

As has been described, the central body portion 42 of the contact 40 is offset from the beam portion 50. The reason for this is that between the major passageways 28 there is only a relatively thin wall of the housing 20. The beam portion 50 of the contact 40 must be of a certain minimum width to obtain proper electrical contact with the pin 54 and the pins 54 have a certain definite spacing. Accordingly, the dimension of the thin wall between the major passageways 28 is fixed. This limits the retentive force that could be generated by the barbs 44. The central body portion 42 is therefore made narrower than the beam portion 50 and is offset and placed in a cavity 30 of smaller width than the major passageway 28 so that the walls between the cavities 30 are more substantial than the walls between the major passageways 28. Accordingly, satisfactory retention by the barbs 44 is attained. This problem did not arise in the assembly of the referenced '615 patent because the pin ends of the contacts were relatively narrow and there was a substantial wall thickness between passageways in the housing.

Accordingly, there has been disclosed an improved connector assembly for terminating a cable for connection to a pin header mounted to a printed circuit board. While a preferred embodiment has been disclosed herein, it will be apparent to those of ordinary skill in the art that various adaptations and modifications to the disclosed arrangement are possible and it is only intended that this invention be limited by the scope of the appended claims.

We claim:

1. An electrical connector assembly for terminating a cable (60) having a plurality of individual insulated wires (58) and for mating with a pin header (32) mounted to a printed circuit board (34) so that electrical connections between the cable wires and wiring traces on the printed circuit board are effected, the assembly comprising:

a housing (20) having a mating face (22) and an opposed rear face (24), said housing being formed with a plurality of contact receiving passageways (26) extending between said mating face and said rear face;

said housing (20) further including a terminal support wall (36) extending beyond said rear face (24) as a continuation of a first wall (38) of the major passageway (28) which is opposite a second wall (65) of the major passageway (28) which communicates with the cavity (30); and a plurality of contacts (40) each in a respective housing passageway and each including:

a generally linear central body portion (42);

a terminal portion (46) at a first end of said central body portion, and including a linear section which engages said terminal support wall (36), said terminal portion including a slotted insulation displacing plate (48) adapted to mechanically and electrically engage an individual cable wire;

a generally linear pin receiving beam portion (50) at the second end of said central body portion, said beam portion being offset from said linear central body portion; where said beam portion (50) is slanted with respect to said contact central body portion (42), and the proximal end of said contact beam portion (50) engages the second wall (65) of said major passageway (28) opposite said first wall (38), the region of engagement being adjacent to where the second wall (65) communicate with the cavity (30); and the distal end of said contact beam portion (50) engages said major passageway first wall (38); and retention means (44) on said central body portion for engaging said housing to retain said each contact within its respective housing passageway;

wherein each of said housing passageways is formed with a major passageway (28) of uniform width extending from said mating face to said rear face and a cavity (30) of width less than said uniform width adjacent to and communicating with said major passageway (28), said cavity (30) extend into said housing from said rear face a distance sufficient to contain therein the central body portion (42) of a contact (40) while the pin receiving beam portion (50) of that contact is contained in the major passageway (28).

2. The assembly according to claim 1 wherein said contact beam portion (50) is wider than said contact central body portion (42) and said cavity (30), and narrower than said uniform width.

3. The assembly according to claim 2 wherein said contact retention means (44) includes at least one barb.

4. The assembly according to claim 2 wherein said contact pin receiving beam portion (50) is channelled at its distal end.

5. The assembly according to claim 2 wherein said contact pin receiving beam portion (50) is split at its distal end.

* * * * *